US005860791A

United States Patent [19]

Kikuchi

[11] Patent Number: 5,860,791

[45] Date of Patent: Jan. 19, 1999

[54] SCROLL COMPRESSOR WITH END-PLATE VALVE HAVING A CONICAL PASSAGE AND A FREE SPHERE

[75] Inventor: Toshiyuki Kikuchi, Isesaki, Japan

[73] Assignee: Sanden Corporation, Gunma, Japan

[21] Appl. No.: 670,062

[22] Filed: Jun. 25, 1996

[30] Foreign Application Priority Data

Jun. 26, 1995 [JP] Japan ..... 7-183515

[51] Int. Cl.[6] ..... F04B 49/02; F04C 18/04

[52] U.S. Cl. ..... 417/310; 418/55.1

[58] Field of Search ..... 417/310; 418/55.5, 418/57, 55.1

[56] References Cited

U.S. PATENT DOCUMENTS

| | | | |
|---|---|---|---|
| Re. 34,148 | 12/1992 | Terauchi et al. . | |
| 2,350,537 | 6/1944 | Scott . | |
| 3,253,607 | 5/1966 | Drutchas . | |
| 3,367,562 | 2/1968 | Persson et al. . | |
| 3,759,057 | 9/1973 | English et al. . | |
| 3,953,153 | 4/1976 | Huber et al. . | |
| 4,382,370 | 5/1983 | Suefuji et al. . | |
| 4,383,805 | 5/1983 | Teegarden et al. . | |
| 4,431,388 | 2/1984 | Eber et al. . | |
| 4,432,708 | 2/1984 | Hiraga et al. . | |
| 4,459,817 | 7/1984 | Inagaki et al. . | |
| 4,468,178 | 8/1984 | Hiraga et al. . | |
| 4,496,296 | 1/1985 | Arai et al. . | |
| 4,498,848 | 2/1985 | Petrovsky et al. . | |
| 4,505,651 | 3/1985 | Terauchi et al. . | |
| 4,557,670 | 12/1985 | Inagaki et al. . | |
| 4,566,863 | 1/1986 | Goto et al. . | |
| 4,642,034 | 2/1987 | Terauchi . | |
| 4,673,340 | 6/1987 | Mabe et al. . | |
| 4,717,314 | 1/1988 | Sato et al. . | |
| 4,744,733 | 5/1988 | Terauchi et al. . | |
| 4,846,633 | 7/1989 | Suzuki et al. . | |
| 4,904,164 | 2/1990 | Mabe et al. . | |
| 4,940,395 | 7/1990 | Yamamoto et al. . | |
| 5,240,388 | 8/1993 | Matsumoto et al. . | |
| 5,336,058 | 8/1994 | Yokoyama . | |
| 5,362,211 | 11/1994 | Iizuka et al. | 417/310 |
| 5,562,426 | 10/1996 | Watanabe et al. | 417/310 |

FOREIGN PATENT DOCUMENTS

| | | |
|---|---|---|
| 0009350 | 4/1980 | European Pat. Off. . |
| 0113786 | 7/1984 | European Pat. Off. . |
| 0144169 | 6/1985 | European Pat. Off. . |
| 0297840 | 1/1989 | European Pat. Off. . |
| 0513827 | 11/1992 | European Pat. Off. . |
| 2338808 | 2/1974 | Germany . |
| 3804418 | 10/1988 | Germany . |
| 55-35156 | 3/1980 | Japan . |
| 58-167893 | 10/1983 | Japan . |
| 60-101295 | 6/1985 | Japan . |
| 62-91680 | 4/1987 | Japan . |
| 63-212789 | 9/1988 | Japan . |
| 1106990 | 4/1989 | Japan . |
| 1318777 | 12/1989 | Japan . |
| 3-18678 | 1/1991 | Japan . |
| 392592 | 4/1991 | Japan . |

OTHER PUBLICATIONS

Patent Abstracts of Japan, vol. 15, No. 138, Apr. 1991.

*Primary Examiner*—Timothy Thorpe
*Assistant Examiner*—Ehud Gartenberg
*Attorney, Agent, or Firm*—Baker & Botts, L.L.P.

[57] ABSTRACT

A variable displacement mechanism of fluid displacement apparatus includes a housing having a suction chamber and a discharge chamber, a first scroll member disposed within said housing and having an end plate from which a first spiral element axially extends, and a second scroll member disposed for non-rotatable orbital movement relative to the first scroll member and having an end plate from which a second spiral element axially extends. At least one control mechanism is disposed on the end plate of the first scroll member for controlling the fluid communication between the fluid pockets and the suction chamber based on the rotational motion of the driving mechanism.

13 Claims, 5 Drawing Sheets

SCROLL COMPRESSOR WITH END-PLATE VALVE HAVING A CONICAL PASSAGE AND A FREE SPHERE

BACKGROUND OF THE INVENTION

1. Field of the Invention

This invention relates to a fluid displacement apparatus, and more particularly, to a scroll type refrigerant compressor with a variable displacement mechanism.

2. Description of the Prior Art

Compressors used in an automotive air conditioning system are typically driven by an automobile engine's power, which is transmitted to the compressor through an electromagnetic clutch. If the compressor is not provided with a variable displacement mechanism, and if the engine is rotating at a high rate, the compressor will be driven at a high rate as well and the operating capacity of the compressor may be larger than necessary. The electromagnetic clutch operates to ensure proper functioning of the compressor. However, under these conditions, the operation of the electromagnetic clutch can cause a large change in the load on the engine, thereby reducing the speed and acceleration performance of the automobile.

A solution to this problem is to provide the compressor with variable displacement mechanism. Scroll type compressors having variable displacement mechanisms for varying the compressor capacity are generally known in the art. Such a compressor is disclosed, for example, in U.S. Pat. No. 4,904,164 issued to Mabe et al.

With reference to FIG. 1, a scroll type compressor includes a housing 10 having a front end plate 11 and a cup-shaped casing 12. Front end plate 11 has an opening 111 through which drive shaft 13 passes. An annular projection 112 extends from a rear surface of front end plate 11. Annular projection 112 faces cup-shaped casing 12 and is concentric with opening 111. Annular projection 112 extends into cup-shaped casing 12, such that an outer peripheral surface of annular projection 112 is adjacent an inner wall surface of opening 121 of cup-shaped casing 12. Opening 121 of cup-shaped casing 12 is thus covered by front end plate 11. An O-ring 14 is placed between the outer peripheral surface of annular projection 112 and inner wall of opening 121 of cup-shaped casing 12 to seal the mating surfaces thereof. An annular sleeve 16 longitudinally projects forward from a front end surface of front end plate 11. Annular sleeve 16 surrounds a portion of drive shaft 13 and partially defines a shaft seal cavity 161. A shaft seal assembly 18 is coupled to drive shaft 13 within shaft seal cavity 161. Drive shaft 13 is supported by annular sleeve 16 through a bearing 17 located within the front end of sleeve 16. Drive shaft 13 has a disk-shaped rotor 131 at its rearward end. Disk-shaped rotor 131 is rotatably supported by front end plate 11 through a bearing 15 located within opening 111 of front end plate 11. A pulley 201 is rotatably supported by a bearing 19, which is disposed on the outer peripheral surface of annular sleeve 16. An electromagnetic coil 202 is fixed by a support plate about the outer surface of annular sleeve 16 and is disposed within pulley 201. An armature plate 203 is elastically supported on the forward end of drive shaft 13. Pulley 201, electromagnetic coil 202 and armature plate 203 form an electromagnetic clutch 20.

A fixed scroll 21, an orbiting scroll 22 and a rotation preventing/thrust bearing mechanism 24 for orbiting scroll 22 are disposed in the interior of housing 10. Fixed scroll 21 includes a circular end plate 211 and a spiral element 212 affixed to and extending from a forward end surface of circular end plate 211. Fixed scroll 21 is fixed within cup-shaped casing 12 by screws (not shown), which are screwed into circular end plate 211 from outside of cup-shaped casing 12. Circular end plate 211 divides the interior of housing 10 into a front chamber 27 and a rear chamber 28. Spiral element 212 of fixed scroll 21 is located within front chamber 27. A partition wall 122 longitudinally projects from the inner end surface of the rear end portion of cup-shaped casing 112 to divide rear chamber 28 into a discharge chamber 281 and an intermediate chamber 282. The forward surface of partition wall 122 contacts the rear end surface of circular end plate 211. Orbiting scroll 22, which is located in front chamber 27, includes a circular end plate 221 and a spiral element 222 extending from a rear end surface of circular end plate 221. Spiral element 222 of orbiting scroll 22 and spiral element 212 of fixed scroll 21 interfit at an angular offset of approximately 180 degrees and a predetermined radial offset to form a plurality of sealed spaces between spiral element 212 and 222. Orbiting scroll 22 is rotatably supported by bushing 23, which is eccentrically connected to the inner end of disk-shaped portion 131 through a radial needle bearing 30. While orbiting scroll 22 orbits, rotation thereof is prevented by rotation preventing/thrust bearing mechanism 24, which is placed between front end plate 11 and circular end plate 221 of orbiting scroll 22.

Compressor housing 10 is provided with an inlet port 31 and outlet port 32 for connecting the compressor to an external refrigeration circuit (not shown). Refrigeration fluid from the external refrigeration circuit is introduced into suction chamber 271 through inlet port 31, and flows into the plurality of sealed spaces formed between spiral elements 212 and 222. The plurality of sealed spaces between the spiral elements sequentially open and close during the orbital motion of orbiting scroll 22. When these spaces are open, fluid to be compressed flows into these spaces. When the spaces are closed, no additional fluid flows into these spaces and compression begins. The outer terminal end of spiral elements 212 and 222 terminate at a final involute angle, the location of the spaces is directly related to the final involute angle. Furthermore, refrigeration fluid in the sealed space is moved radially inwardly and is compressed by the orbital motion of orbiting scroll 22. Compressed refrigeration fluid at a central sealed space is discharged to discharge chamber 281 past valve plate 231 through discharge port 213 formed at the center of circular end plate 211.

A pair of holes (only one hole is shown as hole 214) are formed in circular end plate 211 of fixed scroll 21 and are symmetrically placed so that an axial end surface of spiral elements 222 of orbiting scroll 22 simultaneously crosses over both holes. Hole 214 (and the other holes not shown) provide fluid communication between the plurality of sealed spaces and intermediate pressure chamber 282. Hole 214 is placed at a position defined by involute angle ($\phi$) (not shown) and opens along the inner side wall of spiral element 212. The other hole is placed at a position defined by involute angle ($\phi \cdot \pi$) (not shown) and opens along a radially outside wall of spiral element 212. A pair of valve plates (only one valve plate is shown as valve plate 341) are attached by fasteners (not shown) to the end surface of circular end plate 211 opposite hole 214 and the other holes, respectively. Valve plate 341 and the other valve plate (not shown) are made of a material having spring constant which biases valve plates 341 against the openings of holes 214. When valve plates 341 are forced open due to a pressure difference between the pressure in front chamber 27 and rear chamber 28, valve retainer (not shown) prevents excessive bending of valve plates 341.

Circular end plate 211 of fixed scroll 21 also has communicating channel 29 formed therein and located at a radially outer side portion of the terminal end of spiral element 212. Communicating channel 29 provides fluid communication between suction chamber 271 and intermediate pressure chamber 282.

A control mechanism 36 controls fluid communication between suction chamber 271 and intermediate pressure chamber 282. Control mechanism 36 comprises a first valve element 37 having a cylinder 371 and a piston 372 slidably disposed within cylinder 371. Control mechanism 36 also comprises a second valve element 38. A first opening 373, which opens to intermediate pressure chamber 282, is formed through a side wall of cylinder 371. A second opening 374, which opens to communicating channel 29, is formed at a bottom portion of cylinder 371. A sealing ring member 61 is disposed on an inner surface 122*a* of partition wall 122. An axial annular projection 376 outwardly projects from the bottom of piston 372. A plurality of communicating holes 377 are formed in axial annular projection 376 to provide fluid communication between the interior of piston 372 and space 60. A bias spring 39 is disposed between a rear end surface of circular end plate 211 and the bottom portion of piston 372 to urge piston 372 rightwardly in FIG. 1. An opening formed in cup-shaped casing 12 is normally blocked by a plug 62.

A hollow portion 378 is formed on the inner surface of cover 379 of cylinder 371. Portion 378 exists even if top portion 375 of piston 372 contacts the inner surface of cover 379 of cylinder 371. This configuration allows discharge gas to pass into cylinder 371. An orifice tube 63 is disposed in the side wall of cylinder 371 to lead discharge gas to hollow portion 378 from discharge chamber 281.

Second valve element 38 comprises a bellows 381. A needle ball type valve 382 is attached to a rear end of bellows 381 by pin member 383, and is disposed within piston 372. The bottom of bellows 381 has a screw portion 384, which screws into an inner surface of axial annular projection 376. Screw portion 384 adjusts the initial condition of bellows 381. A valve seat 385 is formed on piston 372. A bias spring 386 is disposed within valve seat 385 and urges needle ball type valve 382 toward screw portion 384. In addition, a sealing member 71 is disposed on an outer peripheral wall of piston 372 to seal a gap between an inner peripheral surface of cylinder 371 and the outer peripheral wall of piston 372.

The operation of control mechanism 36 is as follows. When the compressor is in operation, and is driven in a condition in which the suction pressure is relatively high (i.e., the heat load is relatively great), the pressure of communicating channel 29 is greater than that of predetermined operation pressure of bellows 381, and bellows 381 contracts. As a result needle ball-type valve 382 moves forward to block valve seat 385. Therefore, discharge gas pressure led into cylinder 371 through orifice tube 63 fills hollow portion 378 to urge piston 372 toward circular end plate 211 against the restoring force of bias spring 39. If the heat load is high enough, piston 372 blocks first and second openings 373, 374, thereby preventing communication between suction chamber 271 and intermediate pressure chamber 282.

When the compressor is driven at a condition in which the suction pressure is relatively low (i.e., the heat load is relatively small), bellows 381 expands due to the reduced suction pressure gas which passes into the interior space of piston 372 from communicating channel 29 through communication holes 377. Therefore, needle ball-type valve 382 moves toward cover 379 to open valve seat 385. When valve seat 385 is opened, discharge gas led into hollow portion 378 through orifice tube 63 passes through valve seat 385 through the interior of piston 372, and through communicating holes 377 to communicating channel 29. Consequently, the pressure on the rearward side of top portion 375 is reduced and the rearward bias of piston 372, caused by the suction pressure and the restoring force of bias spring 39, overcomes the forward (leftward in FIG. 1) bias of piston 372. As first and second openings 373 and 374 are opened, communication between suction chamber 271 and intermediate pressure chamber 282 is restored.

Such an arrangement controls the capacity of the compressor by regulating the amount of the fluid flowing from the discharge chamber to the suction chamber via the intermediate chamber when the capacity of the compressor increases undesirably when the compressor is rotated at a high speed. However, such capacity control mechanism of the compressor has many parts and a complex construction. Therefore, this arrangement causes increased cost and assembly time during manufacture of the compressor. Other problems exist with prior art compressors as will be understood by those having ordinary skill in the pertinent art.

SUMMARY OF THE INVENTION

It is an object of the present invention to provide a fluid displacement apparatus with a variable displacement mechanism which is simple in construction and production.

It is another object of the present invention to provide a fluid displacement apparatus for use in an automotive air conditioning system wherein the apparatus has a variable displacement mechanism which has superior responsiveness to the rotational speed of the apparatus.

According to the present invention, a scroll type fluid displacement apparatus includes a housing having therein, a suction chamber and a discharge chamber, a first scroll member disposed within said housing and having an end plate from which a first spiral element axially extends into an interior of the housing, a second scroll member disposed for non-rotatable orbital movement relative to the first scroll member within an interior of the housing and having an end plate from which a second spiral element axially extends into the interior of the housing. The first and second spiral elements interfit at an angular and radial offset to make a plurality of line contacts which define at least one pair of sealed off fluid pockets. The scroll type fluid displacement apparatus includes a drive mechanism operatively connected to at least one of the first and second scroll members. A variable displacement mechanism comprising a ball valve is disposed in a conically shaped cavity formed on the front side of the end plate of the orbiting scroll. The cavity forms a fluid communication path between the central fluid pocket and the suction chamber. The ball valve seats and unseats to close and open, respectively, the fluid communication path based on the pressure differential between the central fluid pocket and the suction chamber and also based on the orbital movement of the orbiting scroll.

Further objects, features and other aspects of this invention will be understood from the following detailed description of the preferred embodiments of this invention with reference to the annexed drawings.

DETAILED DESCRIPTION OF THE PREFERRED EMBODIMENTS

Figure 1:
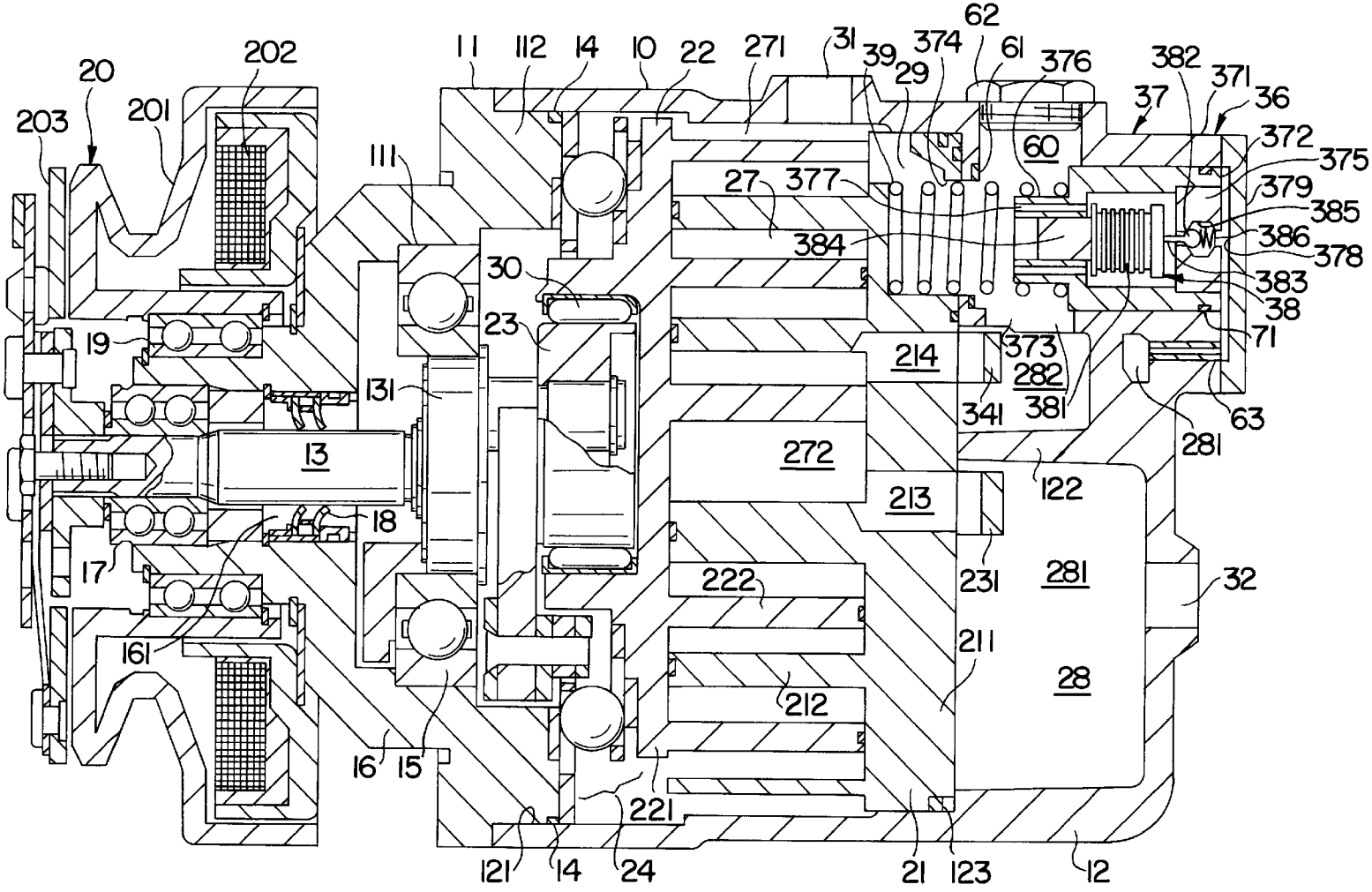
FIG. 1 PRIOR ART
FIG. 1 is a vertical longitudinal sectional view of a scroll type refrigerant compressor in accordance with the prior art.
Figure 2:
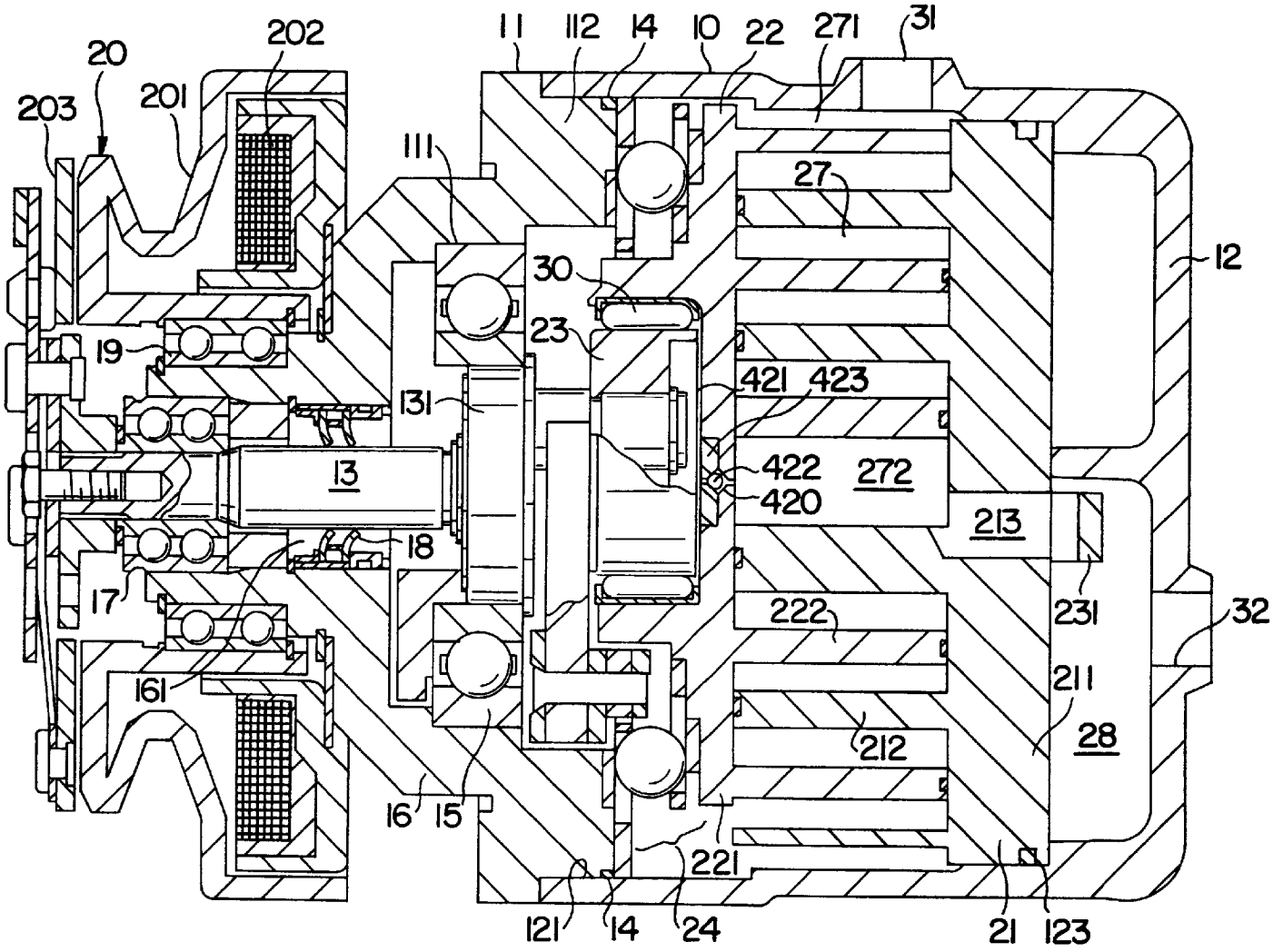
FIG. 2 is a vertical longitudinal sectional view of a scroll type refrigerant compressor in accordance with a first preferred embodiment.

In several respects, the compressor of FIG. 2 is similar to the compressor of FIG. 1. The discussion will be reserved primarily for features differing between the figures, and similar elements are designated by the same reference numerals. Also, merely for convenience, the left side of FIGS. 1–6 is referred to as the front or forward side and the right side is referred to as the rear or rearward side.

Figure 3:
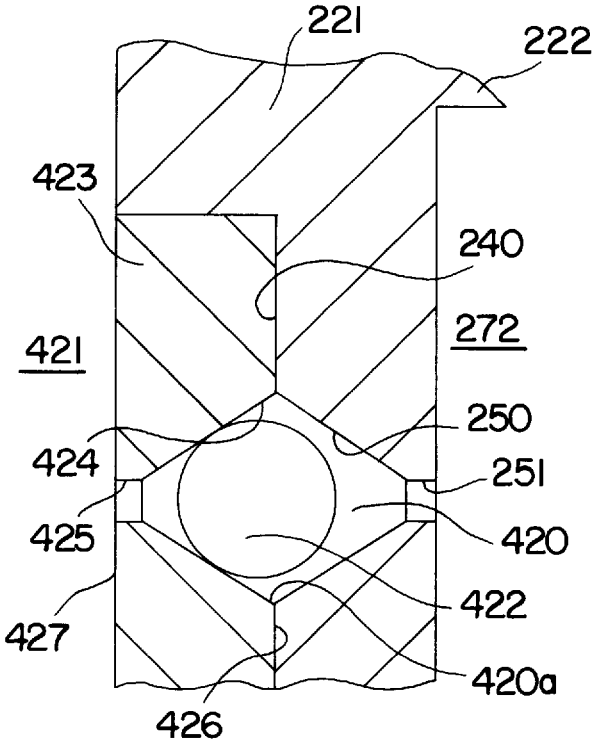
FIG. 3 is an enlarged partial sectional view of a control valve mechanism of a scroll type refrigerant compressor shown in FIG. 2.
Figure 4:
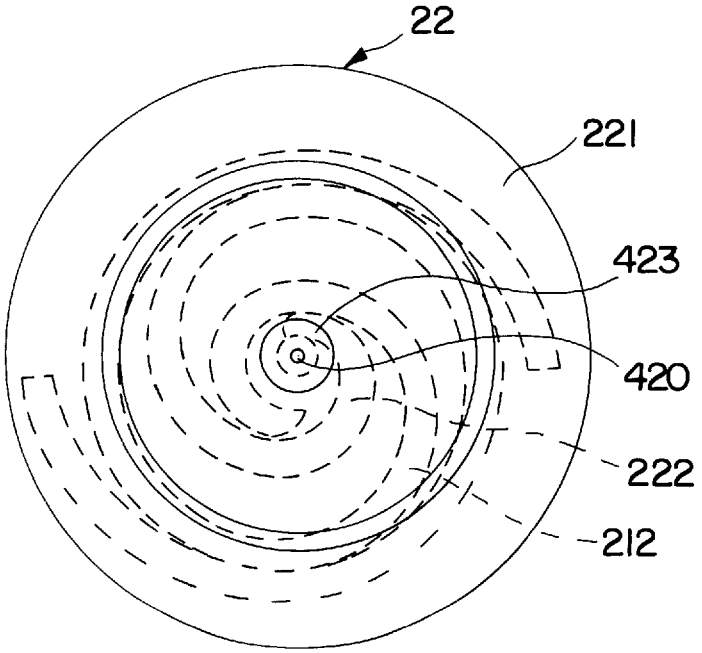
FIG. 4 is an overhead view of an orbiting scroll member of the scroll type refrigerant compressor shown in FIG. 2.

Referring to FIGS. 2–4, end plate 221 of orbiting scroll 22 is provided with a bypass hole 420 formed at the center thereof. Fluid pocket 272 communicates with cavity 421, which is defined by the axial end of bushing 23 and end plate 221. Cavity 421 is in fluid communication with suction chamber 271. End plate 221 includes cylindrical depression 240 formed at the center of front end surface thereof, conical hole 250 extending from cylindrical depression 240 and preferably small cylindrical hole 251 extending from one end of conical hole 250 to fluid pocket 272.

Disk plate 423, which is disposed in cylindrical depression 240, includes conical hole 424 extending from the first end surface 426 thereof and small cylindrical hole 425 extending from second end surface 427 thereof. Disk plate 423 is preferably made of the same material as that of orbiting scroll 22. Disk plate 423 is forcibly inserted into cylindrical depression 240 so that open end of conical hole 424 of disk plate 423 substantially corresponds with open end of conical hole 250. Ball 422 is enclosed between conical hole 250 and conical hole 424.

Cylindrical depression 240, conical hole 250, small cylindrical hole 251, conical hole 424, small cylindrical hole 425 and ball 422 collectively form bypass hole 420. The circumference portion 420*a* of bypass hole 420, which is defined by the mating surfaces of conical hole 250 and conical hole 424, is preferably greater than the diameter of ball 422 so that ball 422 freely moves within bypass hole 420. The changing point of the compressor capacity, which relates to the rotating speed of the compressor and the heat load, can be altered by changing the angle of conical holes 250, 424. In this embodiment, when the rotating speed of the compressor decreases, ball 422 is subjected to a small centrifugal force in the radial direction. Further, the differential pressure, which is caused between fluid pocket 272 and cavity 421, urges ball 422 toward cavity 421 to close bypass hole 420.

When bypass hole 420 is closed, the compressor operates in maximum displacement in accordance with increasing the compression efficiency.

Figure 5:
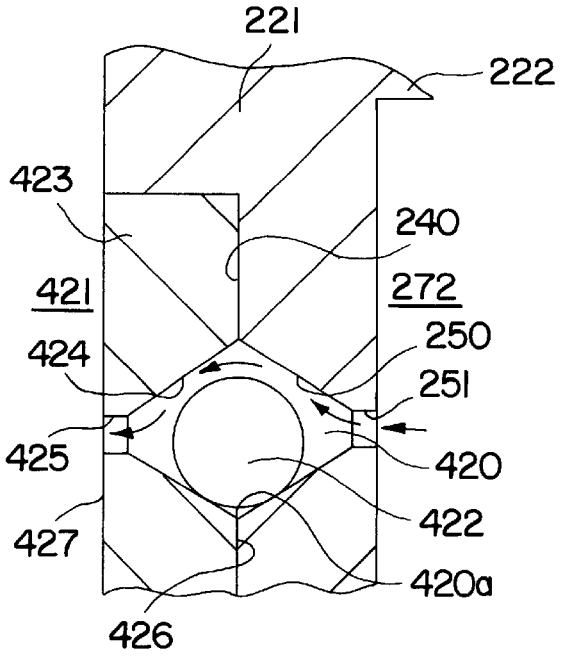
FIG. 5 is an enlarged partial cross sectional view of the control valve mechanism in an open condition.

On the other hand, when the rotating speed of the compressor increases, ball 422 is subjected to great centrigal force in the radial direction. Further, the differential pressure between fluid pocket 272 and cavity 421 urges ball 422 to the center region of bypass hole 420 as shown in FIG. 5, since the centrifugal force is greater than the differential pressure between fluid pocket 272 and cavity 421. The compressed fluid in fluid pocket 272 then flows into cavity 421 through the gap created between circumference 420*a* and peripheral surface of ball 422 as shown by the arrows of FIG. 5. Thus, in the situation of opening bypass hole 420, the compressor operates at minimum displacement in accordance with decreasing compression efficiency.

The valve control mechanism of this embodiment reduces the number of parts and increases the efficiency of the assembly process. As a result, it reduces the cost of the compressor.

Figure 6:
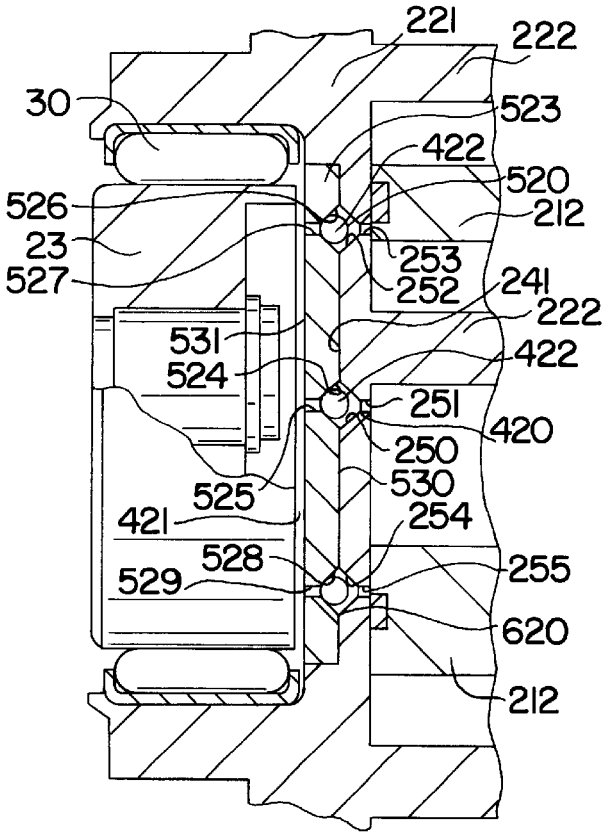
FIG. 6 is an enlarged partial cross sectional view of the control valve mechanism in accordance with a second preferred embodiment.
Figure 7:
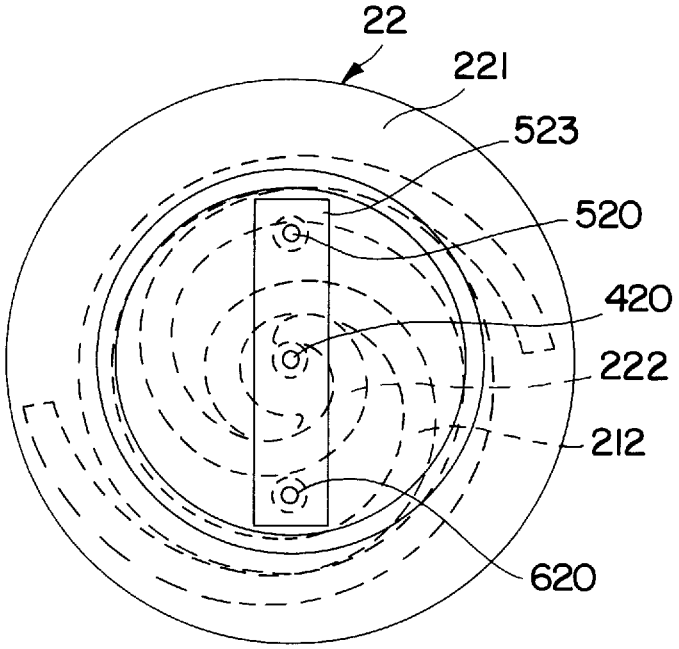
FIG. 7 is an overhead view of an orbiting scroll member of the scroll type refrigerant compressor shown in FIG. 6.

Referring to FIG. 6, a valve mechanism according to a second preferred embodiment is shown. The valve mechanism of the second embodiment is generally similar to the valve mechanism described above. The following discussion will focus on the differences.

End plate 221 of orbiting scroll 22 is provided with a plurality of bypass holes 420, 520 and 620 formed between spiral elements 212 and 222. Fluid pockets 272 communicate with cavity 421, which is defined by the axial end of bushing 23 and end plate 221. Cavity 421 communicates with suction chamber 271. End plate 221 includes cylindrical depression 241 and preferably has a plurality of small cylindrical holes 251, 253 and 255 extending from one end of conical holes 250, 252 and 254 to fluid pockets 272. Disk plate 523 includes a plurality of conical holes 524, 526 and 528 extending from first end surface 530 thereof and a plurality of small cylindrical holes 525, 527 and 529 extending from second end surface 531 thereof. Disk plate 523 is preferably made of the same material as that of orbiting scroll 22. Disk plate 523 is forcibly inserted into cylindrical depression 241 so that the open ends of conical holes 524, 526 and 528 substantially correspond with open ends of conical holes 250, 252 and 254. Balls 422 are enclosed between conical holes 250, 252 and 254 and conical holes 524, 526 and 528. Small cylindrical holes 525, 527 and 529, small cylindrical holes 251, 253 and 255 and balls 422 collectively form bypass holes 420, 520 and 620 and a valve mechanism. Substantially the same effects and advantages as those in the first embodiment are realized in the second embodiment.

Though the present invention has been described in connection with the preferred embodiments, the invention is not limited thereto. It will be easily understood by those of ordinary skill in the art that variations and modifications can be easily made within the scope of this invention as defined by the appended claims.

What is claimed is:

1. A scroll type fluid displacement apparatus comprising a housing having therein, a suction chamber and a discharge chamber, a first scroll member disposed within said housing and having an end plate from which a first spiral element axially extends into an interior of said housing, a second scroll member disposed for non-rotatable orbital movement relative to said first scroll member within the interior of said housing and having an end plate from which a second spiral element axially extends, said first and second spiral elements interfitting at an angular and radial offset to make a plurality of line contacts which define at least one pair of sealed off fluid pockets, and a drive mechanism operatively connected to one of said first and second scroll members to effect relative orbital motion between said first and second scroll members and said line contacts whereby said fluid pockets change in volume as fluid moves from said suction chamber to said discharge chamber, and at least one valve control mechanism disposed on the one of said end plates of said first and second scroll members for controlling fluid communication between said fluid pockets and said suction chamber, said valve control mechanism including at least one bypass hole on the end plate of the one of said first and second scroll members for conducting fluid between said fluid pockets and said suction chamber, said bypass hole having a conical shaped portion, and a free valve member disposed in said conical shaped portion of said bypass hole for opening and closing said bypass hole in response to the rotational motion of said driving mechanism.

2. The assembly recited in claim 1, wherein said valve member opens said bypass hole when a rotational speed of said driving mechanism exceeds a predetermined value.

3. The assembly recited in claim 2, wherein said valve member is a ball.

4. The assembly recited in claim 2, wherein said bypass hole is provided on a radial center of at least one of said end plates of said first and second scroll members.

5. The assembly recited in claim 2, wherein a plurality of said bypass holes are provided on at least one of said end plates of said first and second scroll members.

6. A scroll type fluid displacement apparatus comprising a housing having therein, a suction chamber and a discharge chamber, a first scroll member disposed within said housing and having an end plate from which a first spiral element axially extends into an interior of said housing, a second scroll member disposed for non-rotatable orbital movement relative to said first scroll member within the interior of said housing and having an end plate from which a second spiral element axially extends, said first and second spiral elements interfitting at an angular and radial offset to make a plurality of line contacts which define at least one pair of sealed off fluid pockets, and a drive mechanism operatively connected to one of said first and second scroll members to effect relative orbital motion between said first and second scroll members and said line contacts whereby said fluid pockets change in volume as fluid moves from said suction chamber to said discharge chamber, and at least one valve control mechanism disposed on the one of said end plates of said first and second scroll members for controlling fluid communication between said fluid pockets and said suction chamber, said valve control mechanism including at least one bypass hole on the end plate of the one of said first and second scroll members for conducting fluid between said fluid pockets and said suction chamber, said bypass hole having a first conical shaped portion in said end plate and a second conical shaped portion in a plate member disposed on said end plate, and a free valve member disposed in said first and second conical shaped portions of said bypass hole for opening and closing said bypass hole in response to the rotational motion of said driving mechanism.

7. The assembly recited in claim 2, wherein said valve member is a ball.

8. The assembly recited in claim 2, wherein said bypass hole is disposed at a radial center of said end plate of at least one of said first and second scroll members.

9. The assembly recited in claim 8, wherein a plurality of said bypass holes are provided on said end plate of at least one of said first and second scroll members.

10. A scroll type fluid displacement apparatus comprising a housing having therein, a suction chamber and a discharge chamber, a first scroll member disposed within said housing and having an end plate from which a first spiral element axially extends into an interior of said housing, a second scroll member disposed for non-rotatable orbital movement relative to said first scroll member within the interior of said housing and having an end plate from which a second spiral element axially extends, said first and second spiral elements interfitting at an angular and radial offset to make a plurality of line contacts which define at least one pair of sealed off fluid pockets, and a drive mechanism operatively connected to one of said first and second scroll members to effect relative orbital motion between said first and second scroll members and said line contacts whereby said fluid pockets change in volume as fluid moves from said suction chamber to said discharge chamber, and at least one valve control mechanism disposed on the one of said end plates of said first and second scroll members for controlling fluid communication between said fluid pockets and said suction chamber, said valve control mechanism including at least one bypass hole on the end plate of the one of said first and second scroll members for conducting fluid between said fluid pockets and said suction chamber, said bypass hole having a first conical shaped portion and a first cylindrical shaped portion extending from the conical shaped portion to said fluid pocket and a second conical shaped portion and a second cylindrical shaped portion extending from said second conical shaped portion to said suction chamber, the first and second conical shaped portions having a corresponding open ends forming a common juncture, and a free valve member disposed in said first and second conical shaped portions of said bypass hole for opening and closing said bypass hole in response to the rotational motion of said driving mechanism.

11. The assembly recited in claim 8, wherein said valve member is a ball.

12. The assembly recited in claim 8, wherein said bypass hole is disposed at a radial center of said end plate of at least one of said first and second scroll members.

13. The assembly recited in claim 2, wherein a plurality of said bypass holes are provided on said end plate of at least one of said first and second scroll members.

* * * * *